US011808091B1

(12) United States Patent
Van Ee

(10) Patent No.: US 11,808,091 B1
(45) Date of Patent: Nov. 7, 2023

(54) MODULAR RIG SYSTEMS AND METHODS

(71) Applicant: Lasso Drilling, LLC, Midland, TX (US)

(72) Inventor: Richard Walter Van Ee, Edmonton (CA)

(73) Assignee: Lasso Drilling, LLC, Midland, TX (US)

( * ) Notice: Subject to any disclaimer, the term of this patent is extended or adjusted under 35 U.S.C. 154(b) by 260 days.

(21) Appl. No.: 17/243,913

(22) Filed: Apr. 29, 2021

Related U.S. Application Data

(60) Provisional application No. 63/017,503, filed on Apr. 29, 2020.

(51) Int. Cl.
*E21B 15/00* (2006.01)
*E04H 12/34* (2006.01)

(52) U.S. Cl.
CPC ..... *E21B 15/00* (2013.01); *E04H 12/345* (2013.01)

(58) Field of Classification Search
CPC . E21B 15/00; E21B 7/02; E21B 7/023; E21B 15/003; E21B 15/006; E04H 12/34; E04H 12/18; E04H 12/345; E04H 12/187; E04B 1/3533; E04B 2001/3588
USPC ..... 52/114, 116, 117, 118, 632, 651.05
See application file for complete search history.

(56) References Cited

U.S. PATENT DOCUMENTS 3,922,825 A * 12/1975 Eddy ..... E21B 15/00 52/745.18
4,135,340 A * 1/1979 Cox ..... E21B 15/00 52/125.2
6,634,436 B1 * 10/2003 Desai ..... E21B 15/00 173/186
6,994,171 B2 * 2/2006 Orr ..... E21B 15/00 173/24
2004/0211572 A1 * 10/2004 Orr ..... E21B 15/00 173/28
2004/0211598 A1 * 10/2004 Palidis ..... E21B 7/02 175/203
2005/0193645 A1 * 9/2005 Barnes ..... E21B 7/02 52/120
2008/0251267 A1 * 10/2008 Cicognani ..... E21B 15/00 173/28
2009/0000218 A1 * 1/2009 Lee ..... E21B 15/00 173/151

(Continued)

*Primary Examiner* — Babajide A Demuren
(74) *Attorney, Agent, or Firm* — AVEK IP, LLC

(57) ABSTRACT

A modular rig system assembled without use of a crane includes a platform and a mast. The platform has pin retaining structure. The mast is separable from the platform and has a transport foundation, a tower, an alignment actuator, a pin, and a piston arm. The tower has pin retaining structure and is movable relative to the transport foundation between transport and use configurations. The alignment actuator is operably coupled to the transport foundation to adjust positioning of the tower while the tower is at the transport configuration such that the platform pin retaining structure and the tower pin retaining structure are aligned. The pin selectively passes through the platform pin retaining structure and the tower pin retaining structure to couple the platform to the tower, and the piston arm is pivotably coupled to the transport foundation and the tower for moving the tower between the transport and use configurations.

20 Claims, 15 Drawing Sheets

(56) References Cited

U.S. PATENT DOCUMENTS

| | | | | |
|---|---|---|---|---|
| 2009/0218138 | A1* | 9/2009 | Donnally | E21B 7/023<br>175/57 |
| 2009/0218139 | A1* | 9/2009 | Donnally | E21B 7/02<br>175/57 |
| 2009/0218144 | A1* | 9/2009 | Donnally | E21B 7/02<br>175/162 |
| 2009/0321135 | A1* | 12/2009 | Vora | E21B 19/00<br>175/203 |
| 2011/0072737 | A1* | 3/2011 | Wasterval | E21B 7/021<br>52/745.18 |
| 2012/0047820 | A1* | 3/2012 | Donnally | E21B 15/00<br>52/745.18 |
| 2012/0066999 | A1* | 3/2012 | Donnally | E04H 12/10<br>52/745.18 |
| 2012/0167485 | A1* | 7/2012 | Trevithick | E04H 12/345<br>52/645 |
| 2013/0269268 | A1* | 10/2013 | Thiessen | E04B 1/3533<br>175/57 |
| 2013/0291452 | A1* | 11/2013 | Donnally | E21B 7/00<br>52/745.18 |
| 2015/0047290 | A1* | 2/2015 | Konduc | E04H 12/344<br>52/745.18 |
| 2015/0143759 | A1* | 5/2015 | Sparkman | E21B 15/00<br>52/745.18 |

* cited by examiner

MODULAR RIG SYSTEMS AND METHODS

CROSS-REFERENCE TO RELATED APPLICATIONS

This application claims priority to U.S. Application No. 63/017,503, filed Apr. 29, 2020, which is incorporated by reference in its entirety herein.

FIELD OF THE DISCLOSURE

The disclosure relates generally to the field of drilling rigs. More specifically, the disclosure relates to a drilling rig that is modularly assembled.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

According to an embodiment, a modular rig system includes a platform having an attachment point and a mast separable from the platform. The mast has a transport foundation, a tower, and an alignment actuator. The tower is movable relative to the transport foundation between transport and use configurations, and the tower has an attachment point. The alignment actuator is operably coupled to the transport foundation to adjust positioning of the tower while the tower is at the transport configuration such that the platform attachment point and the tower attachment point are aligned. A piston arm is pivotably coupled to the transport foundation and the tower for moving the tower between the transport and use configurations.

According to another embodiment, a modular rig system assembled without use of a crane includes a platform and a mast. The platform has pin retaining structure. The mast is separable from the platform and has a transport foundation, a tower, an alignment actuator, a pin, and a piston arm. The tower is movable relative to the transport foundation between transport and use configurations, and the tower has pin retaining structure. The alignment actuator is operably coupled to the transport foundation to adjust positioning of the tower while the tower is at the transport configuration such that the pin retaining structure of the platform and the pin retaining structure of the tower are aligned. The pin selectively passes through the pin retaining structure of the platform and the pin retaining structure of the tower to couple the platform to the tower, and the piston arm is pivotably coupled to the transport foundation and the tower for moving the tower between the transport and use configurations.

According to still another embodiment, a method of assembling a rig system without a crane includes the steps of affixing a platform atop a base; affixing a transport foundation of a mast atop the base, with the mast having a tower and a piston arm, and with the piston arm being rotatably coupled to the mast and to the transport foundation; adjusting a position of the tower using a linear alignment actuator such that an attachment point of the tower is aligned with an attachment point of the platform; pinning the attachment point of the tower to the attachment point of the platform; and raising the tower using the piston arm.

BRIEF DESCRIPTION OF THE SEVERAL VIEWS OF THE DRAWINGS

Illustrative embodiments of the disclosure are described in detail below with reference to the attached drawing figures.

DETAILED DESCRIPTION

Figure 1:
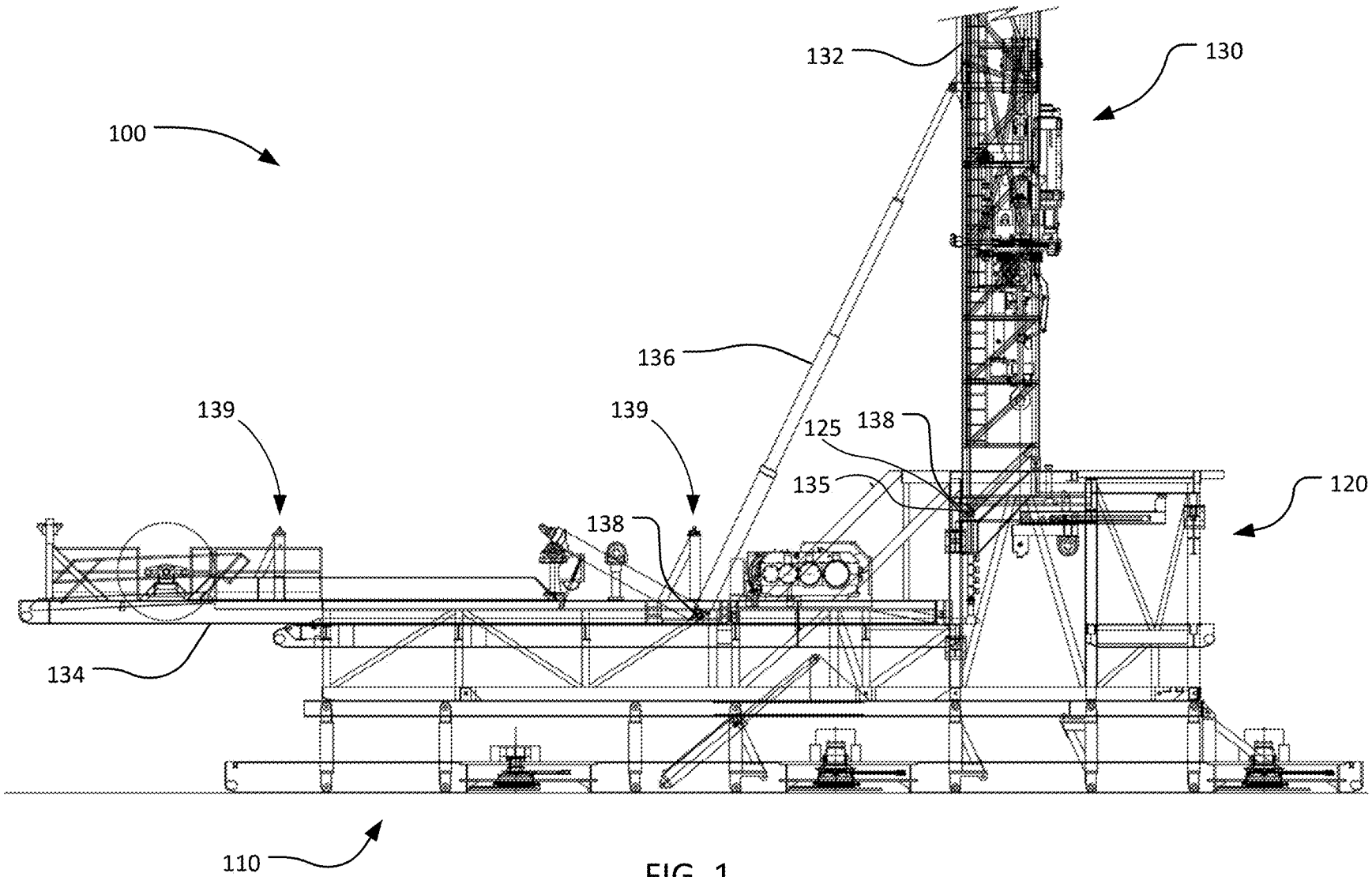
FIG. 1 is a side view of a modular rig system, according to an embodiment.

Systems and methods for assembling drilling rigs, such as oil drilling rigs, are known in the art. These conventional systems and methods typically require a significant amount of time and heavy machinery (e.g., trucks, assembly vehicles, cranes, et cetera) to complete, due to the sheer size and weight of the rig components. For example, it generally takes about five days just to assemble some conventional rigs, and assembly requires the use of a crane to lift and place the towers or masts of the conventional rigs. Transporting these conventional rigs, and the heavy machinery required for their assembly, from one drilling site to the next also adds a significant amount of time and manpower to the process.

Another issue with the conventional rig systems is that they are typically designed to accomplish a specific kind of drilling task. A conventional rig system may not be suited for every drilling task characteristic (e.g., type of drilling required, size of derrick or tower required, et cetera). To overcome this and complete the drilling task, another conventional rig system would have to be brought in, which furthers the problem of transport and assembly being time consuming and expensive. Overall, the conventional assembly systems and processes are cumbersome and the heavy machinery required to facilitate them is expensive. It follows that a rig assembly system and method that may be assembled quicker, assembled with less heavy machinery, and/or that may be more versatile is desirable. Embodiments of the modular rig systems and methods disclosed herein may provide for such a system.

FIGS. 1 through 8 depict a modular rig system 100 and an associated modular rig assembly method 200, according to an embodiment. The modular rig system 100 includes a base 110, a platform 120, and a mast 130. And in some embodiments, the modular rig system 100 further includes a computing system 140. As described below, the modular rig system 100 may be transported (e.g., by vehicles 50) to a drilling site and quickly assembled there (FIGS. 7A through 7G), while requiring less heavy machinery (e.g., foregoing a crane) relative to conventional rig systems.

Figure 2A:
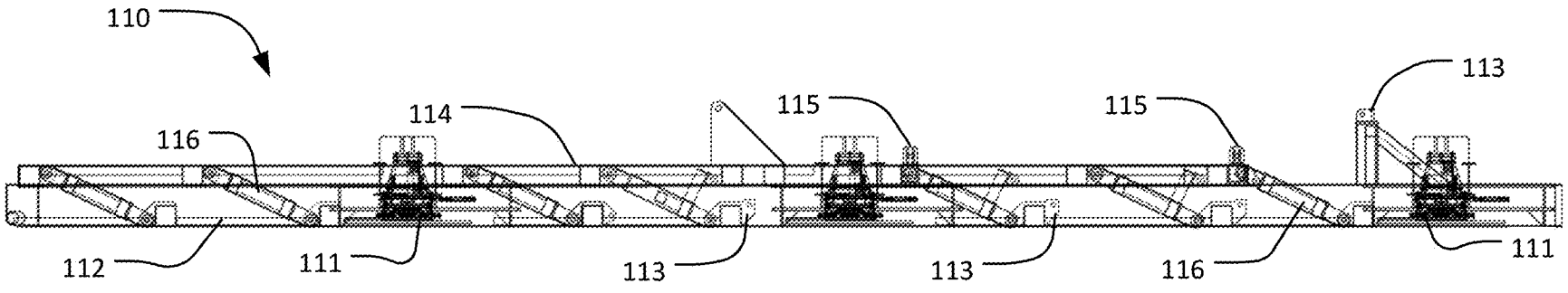
FIG. 2A is a side view of an adjustable base of the modular rig system of FIG. 1, in a collapsed state.
Figure 2B:
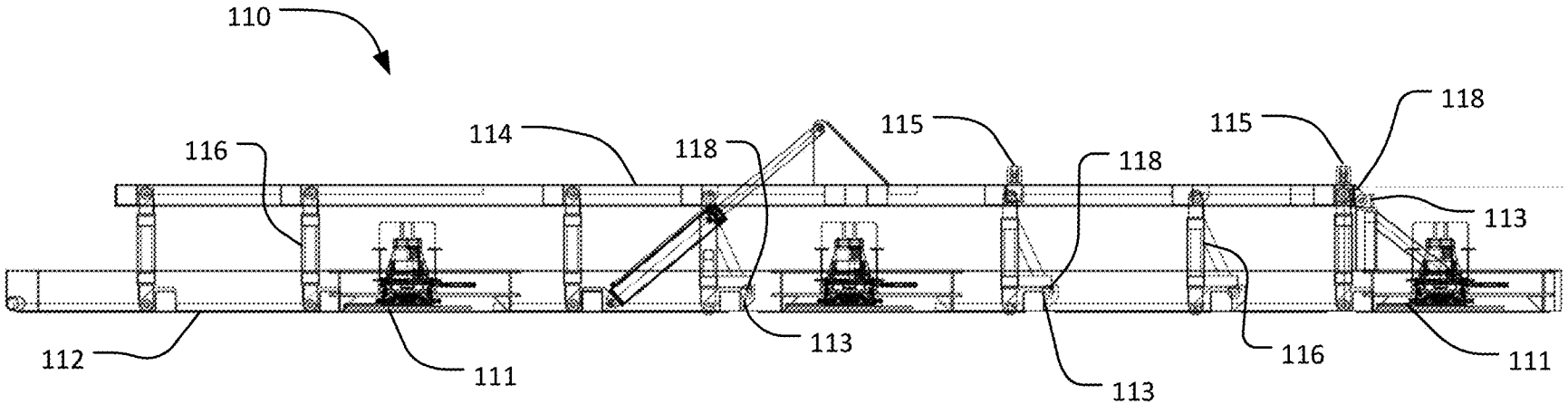
FIG. 2B is a side view of the adjustable base of the modular rig system of FIG. 1, in an extended state.
Figure 4:
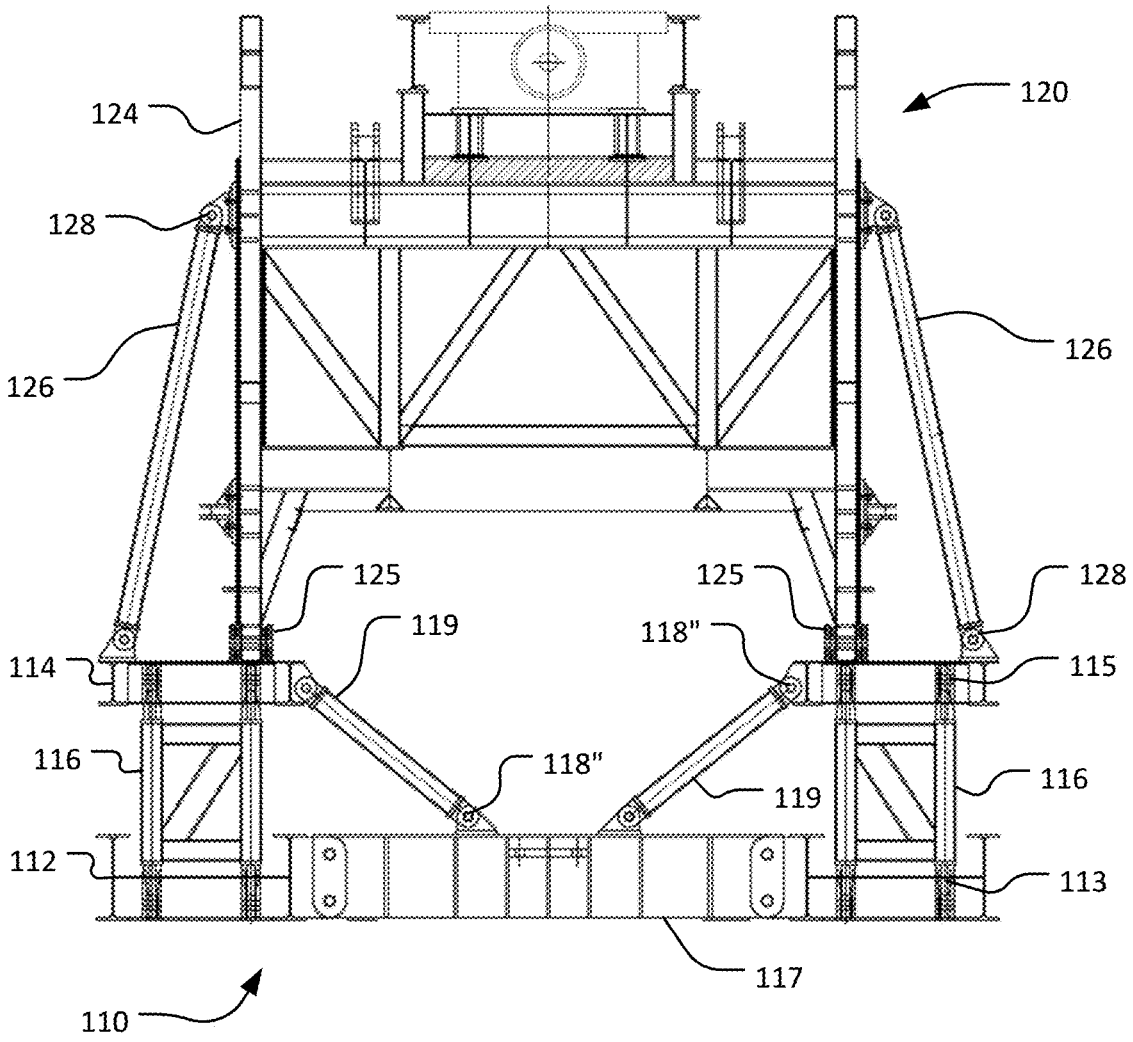
FIG. 4 is a cross section of the platform and the adjustable base of FIG. 3.
Figure 5A:
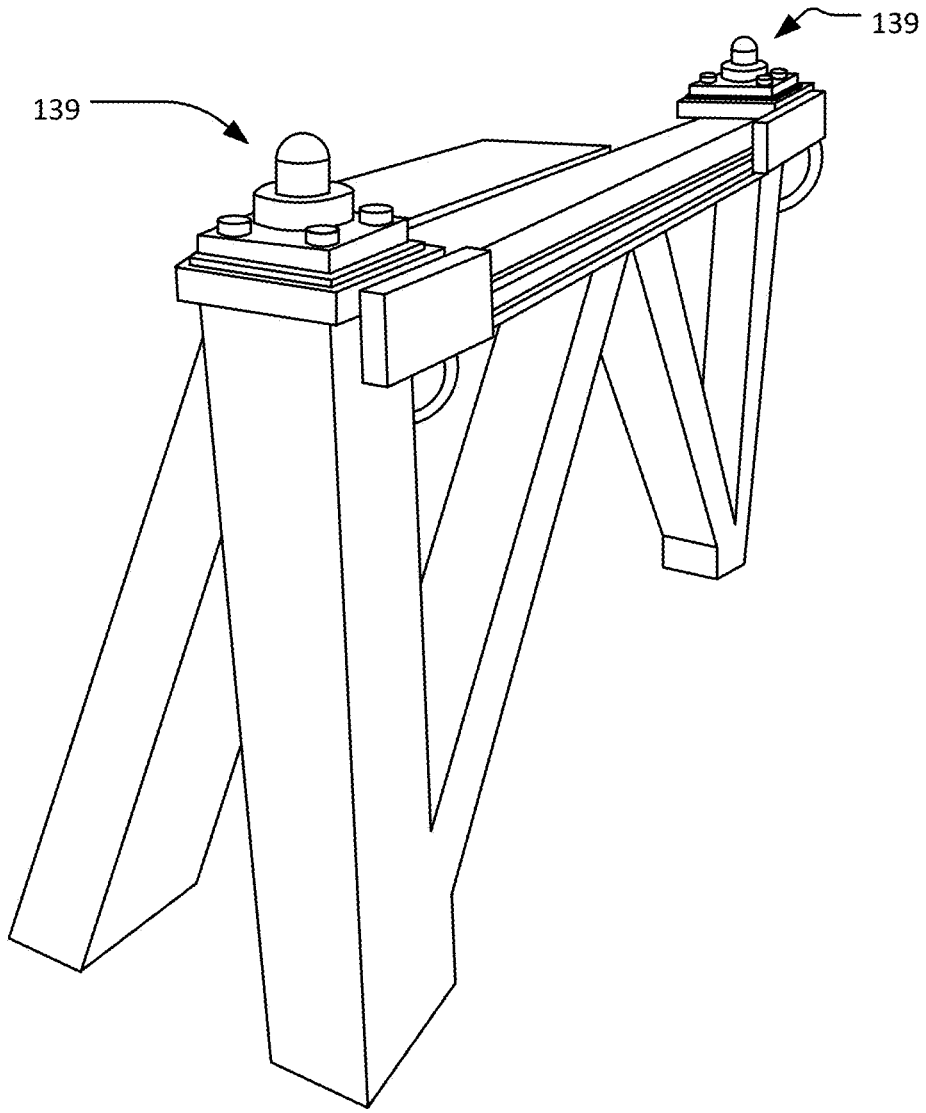
FIG. 5A is a perspective view of alignment actuators of the modular rig system of FIG. 1.
Figure 5B:
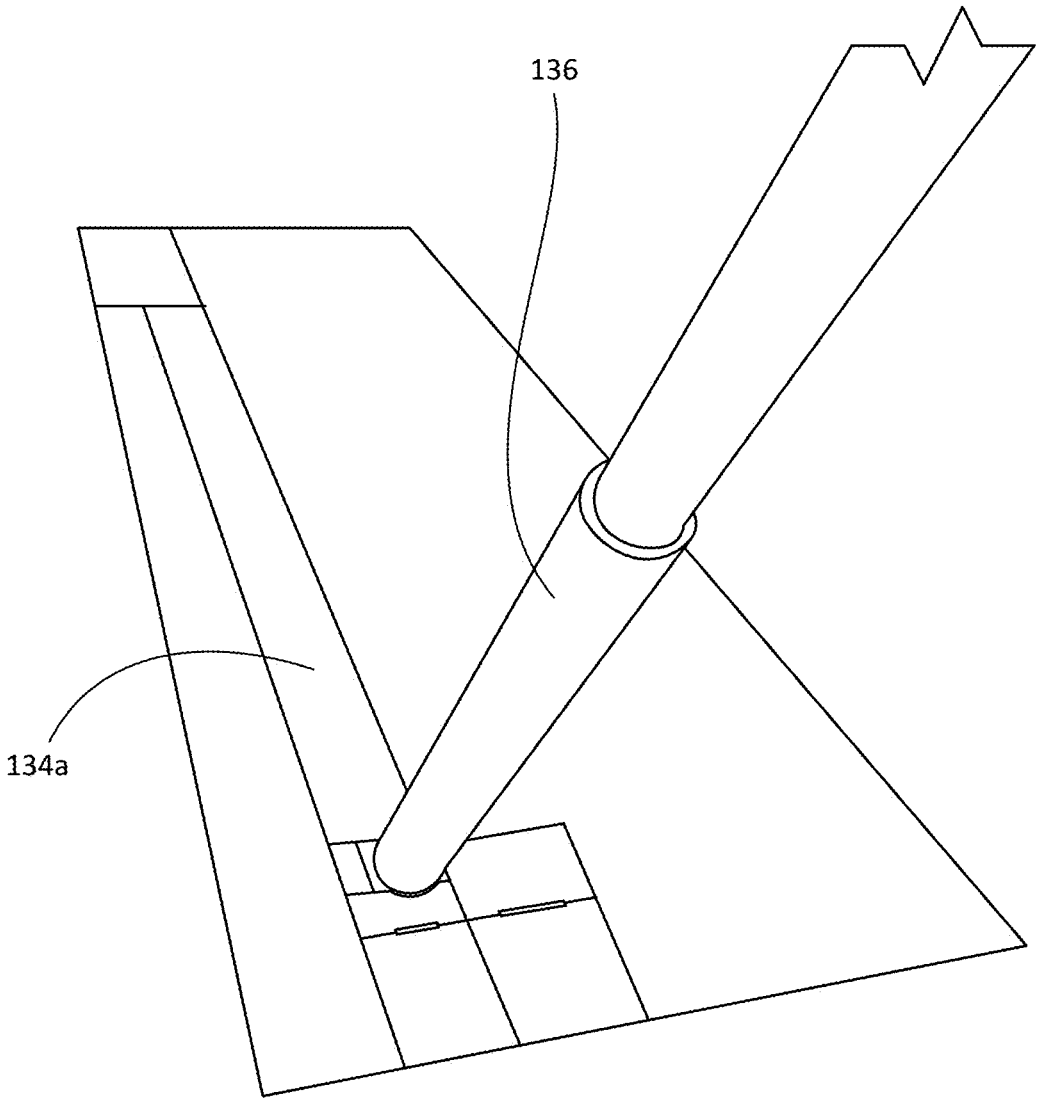
FIG. 5B is a perspective view of a piston arm and decking of the modular rig system of FIG. 1.

The base 110 may be an adjustable base (also referred to as a "slingshot") and may have feet 111, a foundation 112, first retaining structure 113, a base platform 114, second retaining structure 115, legs 116, and pins 118, as shown in FIGS. 2A and 2B. In some embodiments, the adjustable base 110 may include one or more spreader supports 117 and/or braces 119 (FIG. 4).

The adjustable base 110 may serve as a foundation for the platform 120 and the mast 130 and may be selectively changeable between one position (FIG. 2A) where the adjustable base 110 is collapsed and another position (FIG. 2B) where the adjustable base 110 is uncollapsed or extended. The adjustable base 110 may be selectively changed from the collapsed position to the extended position (or vice versa) through a system 100 input, such as a user command (e.g., via, the computing system 140, a button push, et cetera), and the collapsed position may facilitate transport of the adjustable base 110 by decreasing the overall dimensions of the adjustable base 110.

The foundation 112 and the base platform 114 may provide the main structure of the adjustable base 110, with the foundation 112 being a portion of the adjustable base 110 which is nearer to the ground when the modular rig 100 is assembled. The feet 111 may extend from the foundation 112 and may be adjusted when placing the base 110 at a drilling site. For instance, each of the feet 111 may be moved up, down, in, out, left, and/or right to compensate for any uneven terrain the adjustable base 110 may be located on. As such, the adjustable base 110 may be made stable and level.

Each of the legs 116 may be a movable (e.g., extendable and retractable) device that is mounted between the foundation 112 and the base platform 114, and may cause the adjustable base 110 to move between the collapsed and extended positions. The legs 116 may be movable through any method now known or subsequently developed (e.g., hydraulic power, pneumatic power, mechanical power, et cetera), though actuators that use hydraulic power may be particularly desirable due to the sheer weight of the modular rig system 100 that the legs 116 may have to move when changing between the collapsed and extended positions. The legs 116 may selectively transition between a position where the legs 116 remain unextended/unrotated and another position where the legs 116 are extended/rotated. By being linked to both the foundation 112 and the base platform 114, movement of the legs 116 transitions the adjustable base 110 between the collapsed condition (FIG. 2A) and the extended position (FIG. 2B).

The plurality of pins 118 may selectively retain the adjustable base 110 in place at the extended position by being inserted within the corresponding first retaining structure 113. The pins 118 may be inserted using any suitable method, such as motor-driven insertion or manual insertion (e.g., with a hammer). In use, the plurality of pins 118 may selectively secure the adjustable base 110 in the extended position, and may preclude the adjustable base 110 from undesirably collapsing back into the collapsed position. When the modular rig 100 is to be packed up (e.g., for transport to a new location), the pins 118 may be removed to allow the legs 116 to move, in turn allowing the adjustable base 110 to be returned to the collapsed position.

The second pin retaining structure 115 may extend from the base platform 114. Like the first pin retaining structure 113, the second pin retaining structure 115 may be configured to receive pins such that other structure (e.g., the platform 120) may be selectively secured to the adjustable base 110. Also like the first pin retaining structure 113, the second pin retaining structure 115 may receive pins through any suitable method, such as manual or motor-driven methods. In some embodiments, the second pin retaining structure 115 is configured to retain pins 128 (FIG. 3), which may be substantially similar to the pins 118.

In some embodiments, the adjustable base 110 may include one or more separable spreader supports 117 and/or braces 119 (FIG. 4). The spreader supports 117 may be supports that extend from the foundation 112 and/or the base platform 114, and may provide resistance to lateral forces that are experienced by the adjustable base 110. The spreader supports 117 may be selectively secured to the foundation 112 and/or the base platform 114 via removable pins 118. Similarly, the braces 119 may use pins 118 to selectively link the spreader supports 117 to the rest of the adjustable base 110 (e.g., via the base platform 114), and thereby provide support thereto. In use, the separable spreader supports 117 and braces 119 may allow the adjustable platform 110 to be further reduced in size when the adjustable base 110 is placed in the collapsed position and the spreader supports and braces 119 are removed. A reduction in size may make transporting the collapsed adjustable platform 110 easier.

Figure 3:
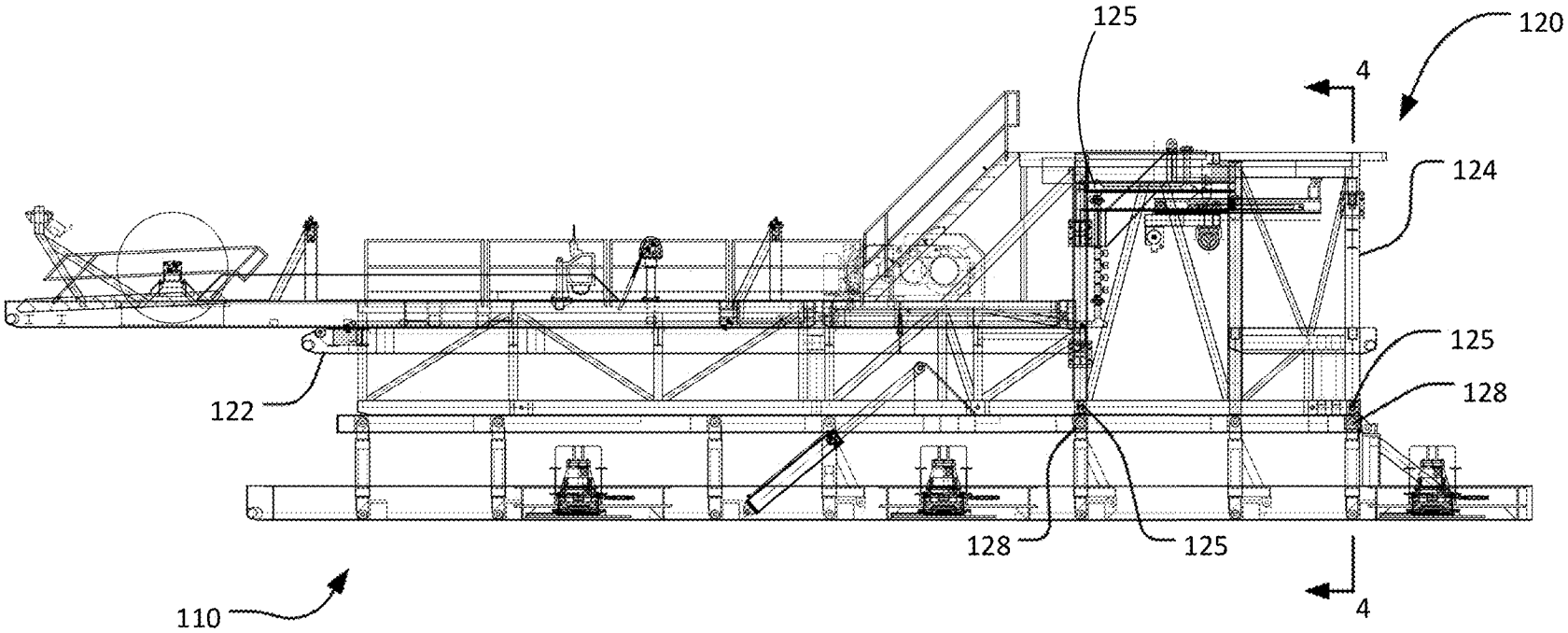
FIG. 3 is a side view of a platform and the adjustable base of the modular rig system of FIG. 1.

Moving now to the FIGS. 3 and 4, the platform 120 is shown to include a staging portion 122, a tower receiving portion 124, pin retaining structure 125, braces 126, and the platform pins 128. The platform 120 is removably attached to the adjustable base 110 and is configured to receive the mast 130 (e.g., via the tower receiving portion 124). The platform 120 may also include any other suitable drilling equipment as desired, such as equipment configured to operate a drill. In some embodiments, the equipment may be specifically configured to handle a certain task. In this manner, multiple platforms 120 may each be configured to handle a different type of drilling task, such as by having equipment that supports different drill sizes, derrick heights, and/or types of drilling (e.g., auger drilling, percussion rotary air blast drilling, air core drilling, cable tool drilling, reverse circulation drilling, diamond core drilling, hydraulic rotary drilling, direct push drilling, sonic drilling, et cetera). These multiple platforms 120 configured for different tasks may expand the versatility of the modular rig system 100 by allowing the modular rig system 100 to be configured to achieve a desired set of drilling task characteristics (e.g., type of drilling, drill size, derrick heights, et cetera).

The pin retaining structure 125 of the platform 120 may be selectively securable to other structure, such as the adjustable base 110 and the mast 130. To accomplish this, the pin retaining structure 125 may be aligned with corresponding retaining structure (e.g., pin retaining structure 115), and a pin (e.g., pin 118, pin 128) may be inserted therein to temporarily join the parts together. In operation, the pin retaining structure 125 may allow for quick and easy assembly of the platform 120 with the other components of the modular rig system 100.

In some embodiments, the platform 120 includes braces 126 which may be selectively secured (e.g., via pins 128) to and extend between the platform 120 and the adjustable base 110, as seen in FIG. 4. The braces 126 may provide additional support to the modular rig 100 to ensure rig integrity when assembled.

Returning now to FIG. 1, the mast 130 may include a tower 132 (sometimes referred to herein as a "derrick"), a mast platform (or "transport foundation") 134, a mast pin retaining structure 135, one or more piston arms 136, pins 138, and an alignment actuator 139. The tower 132 may be any suitable size for drilling (e.g., single stand, double stand, triple stand, quadric stand, etc.), and may be configured to operate any suitable type of drill. In some embodiments, multiple towers 132 with different characteristics may be available, thus giving a user the ability to select a respective tower 132 that satisfies certain drilling task characteristics and attach it to the platform 120 and the adjustable base 110.

Figure 7A:
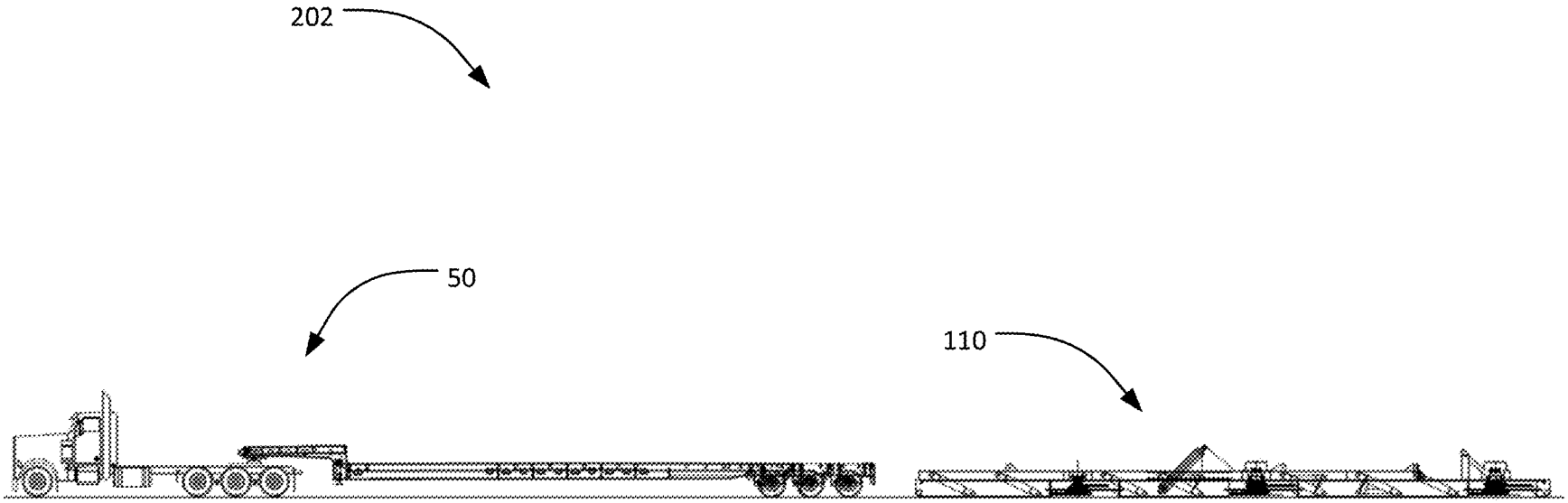
FIGS. 7A-7G are schematic views illustrating steps of the method of FIG. 6.
Figure 7B:
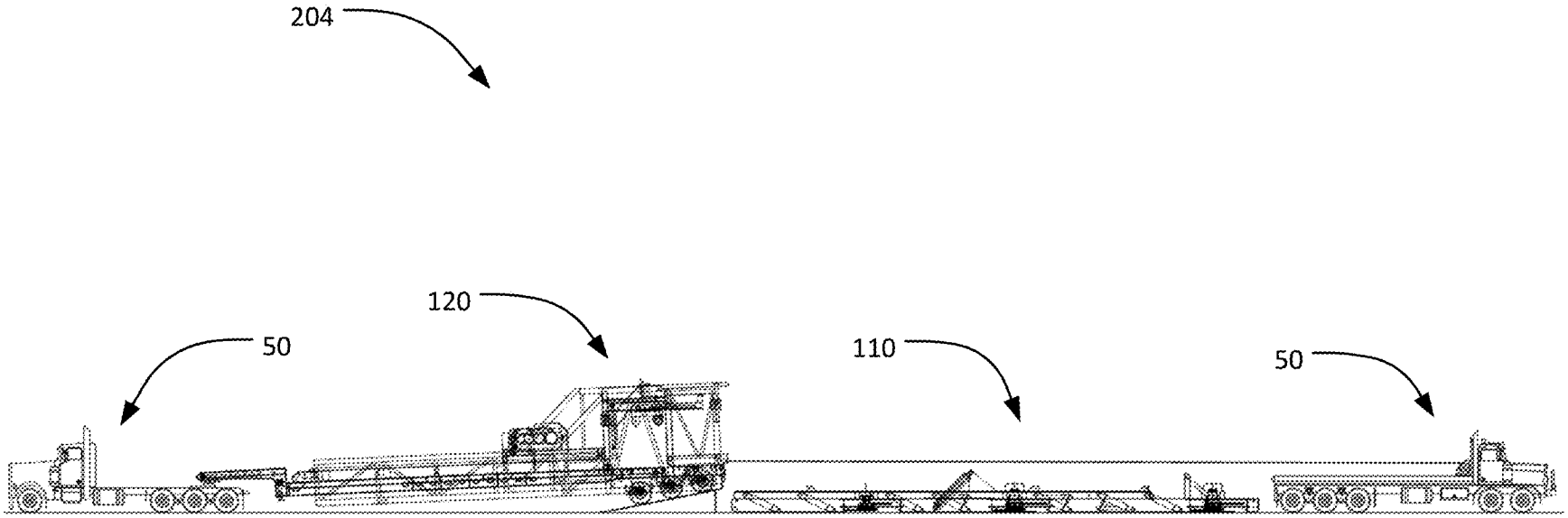
Figure 7C:
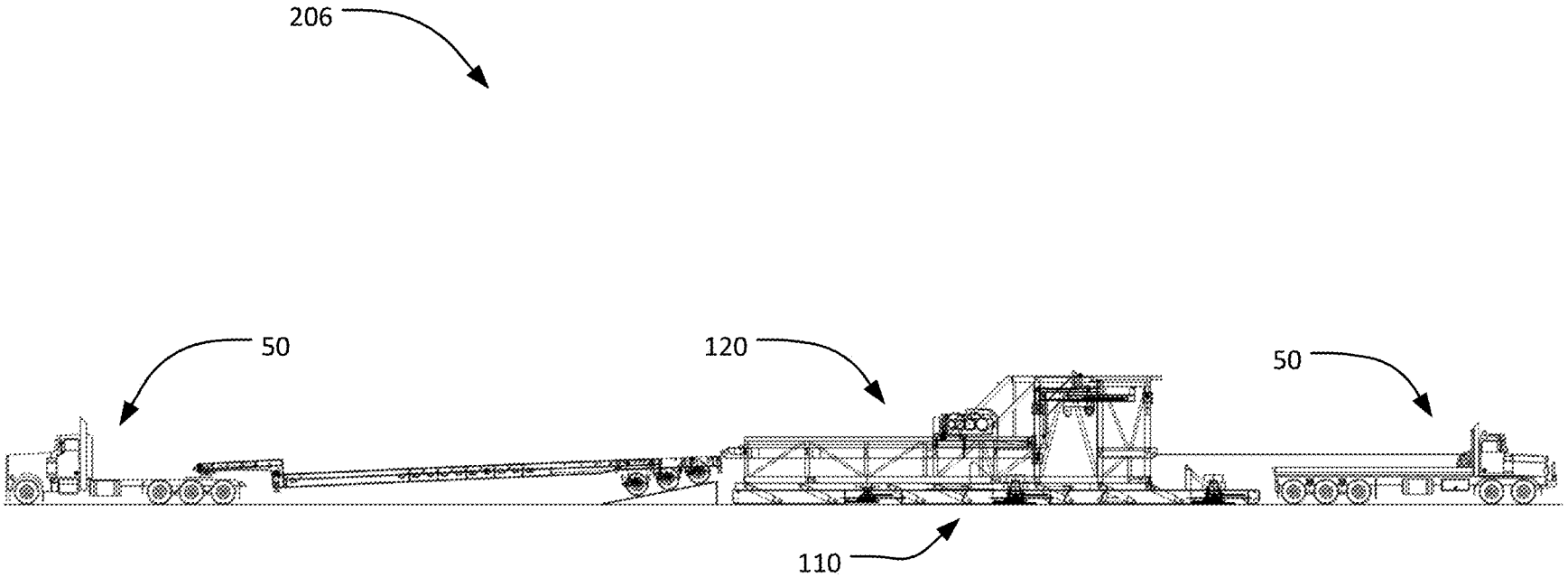
Figure 7D:
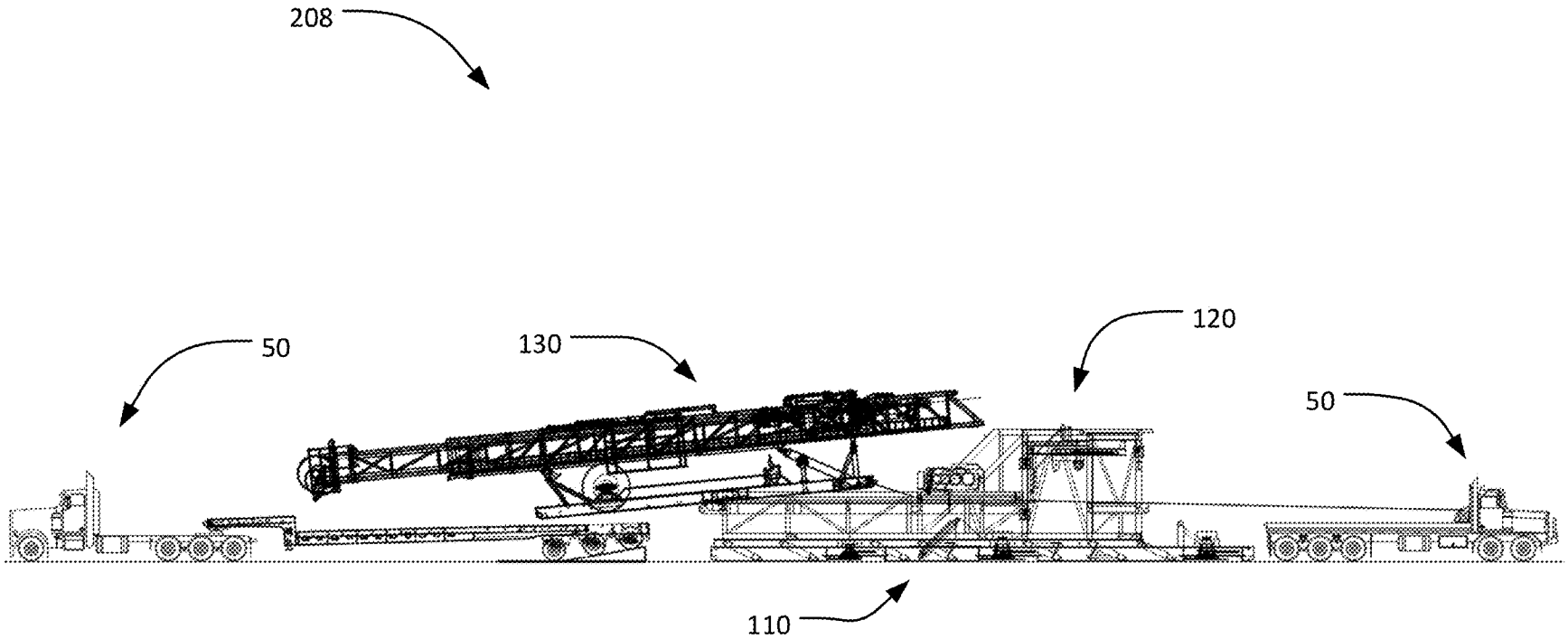
Figure 7E:
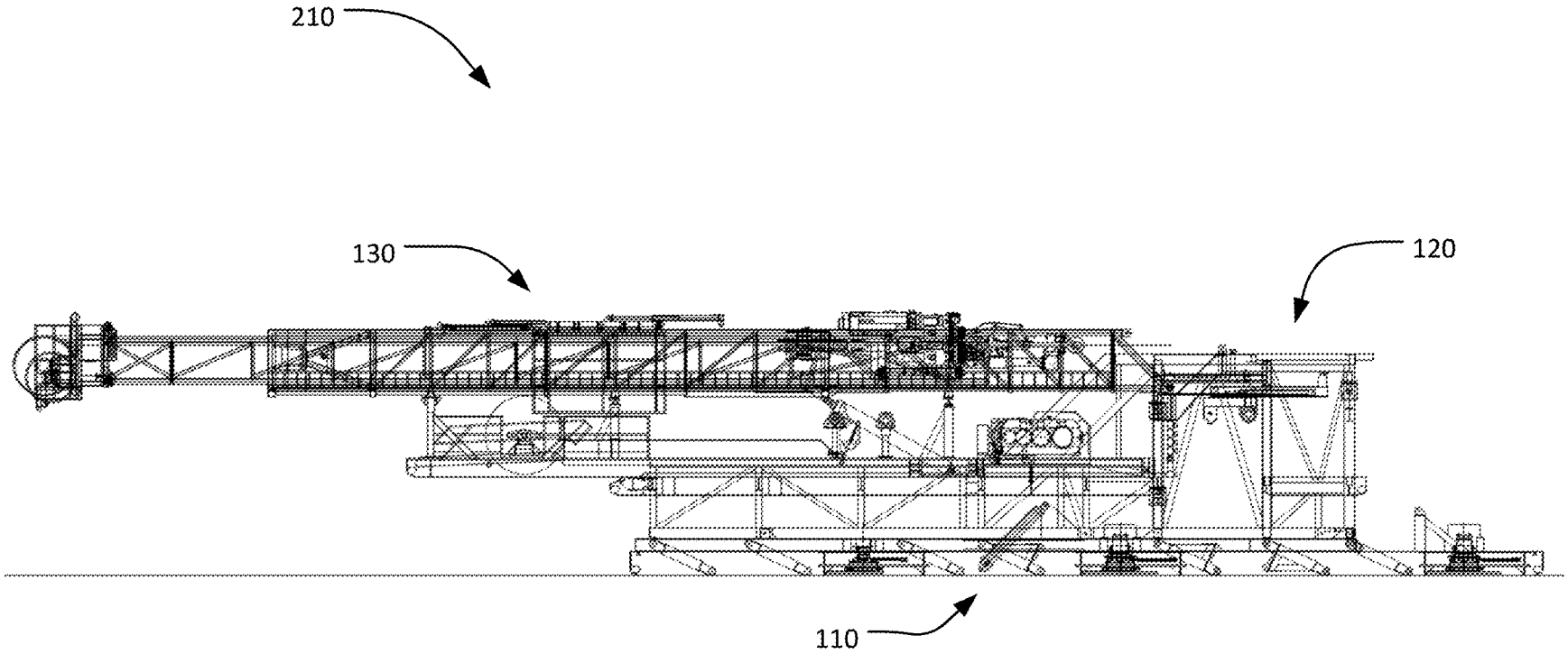
Figure 7F:
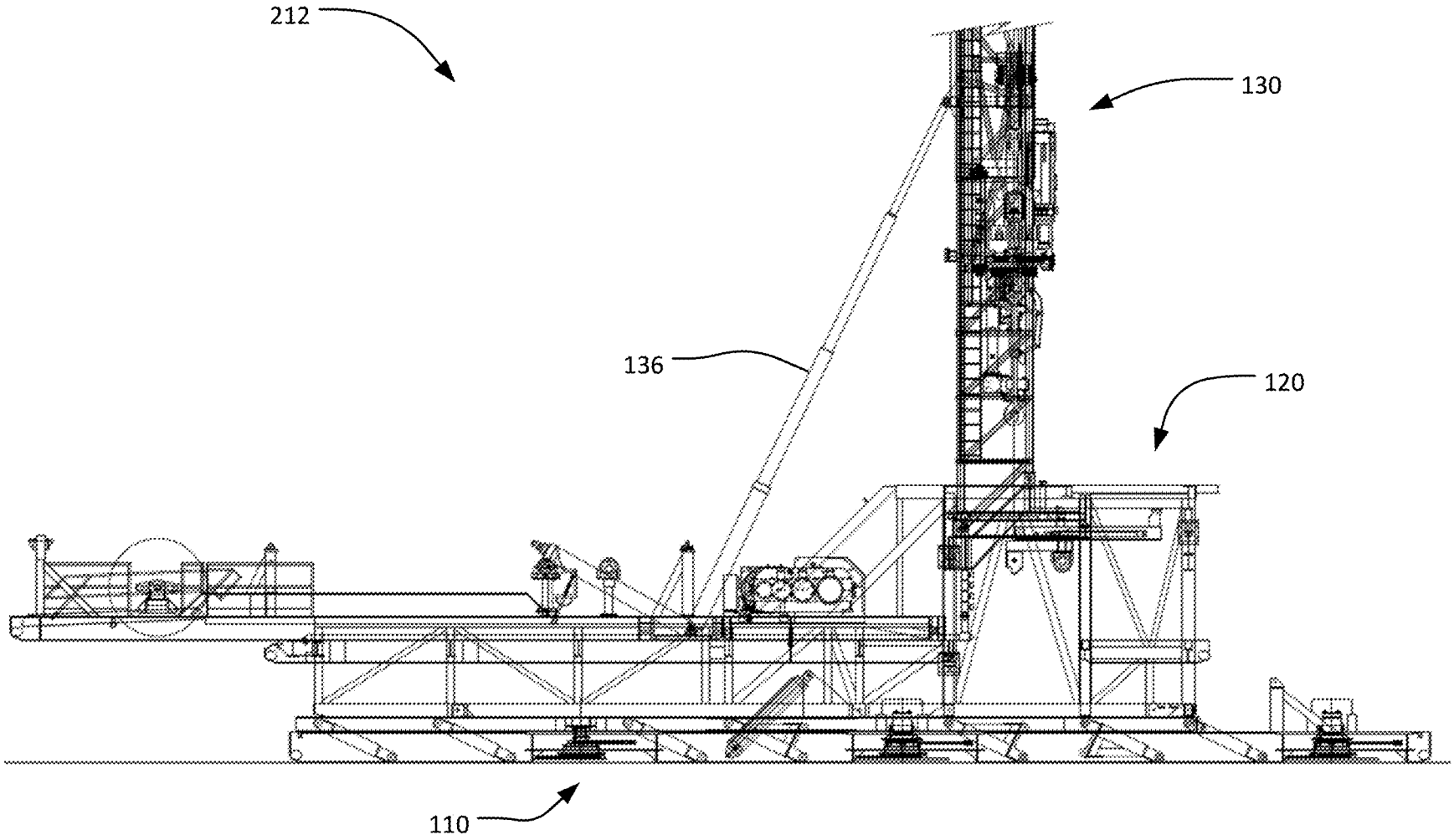
Figure 7G:
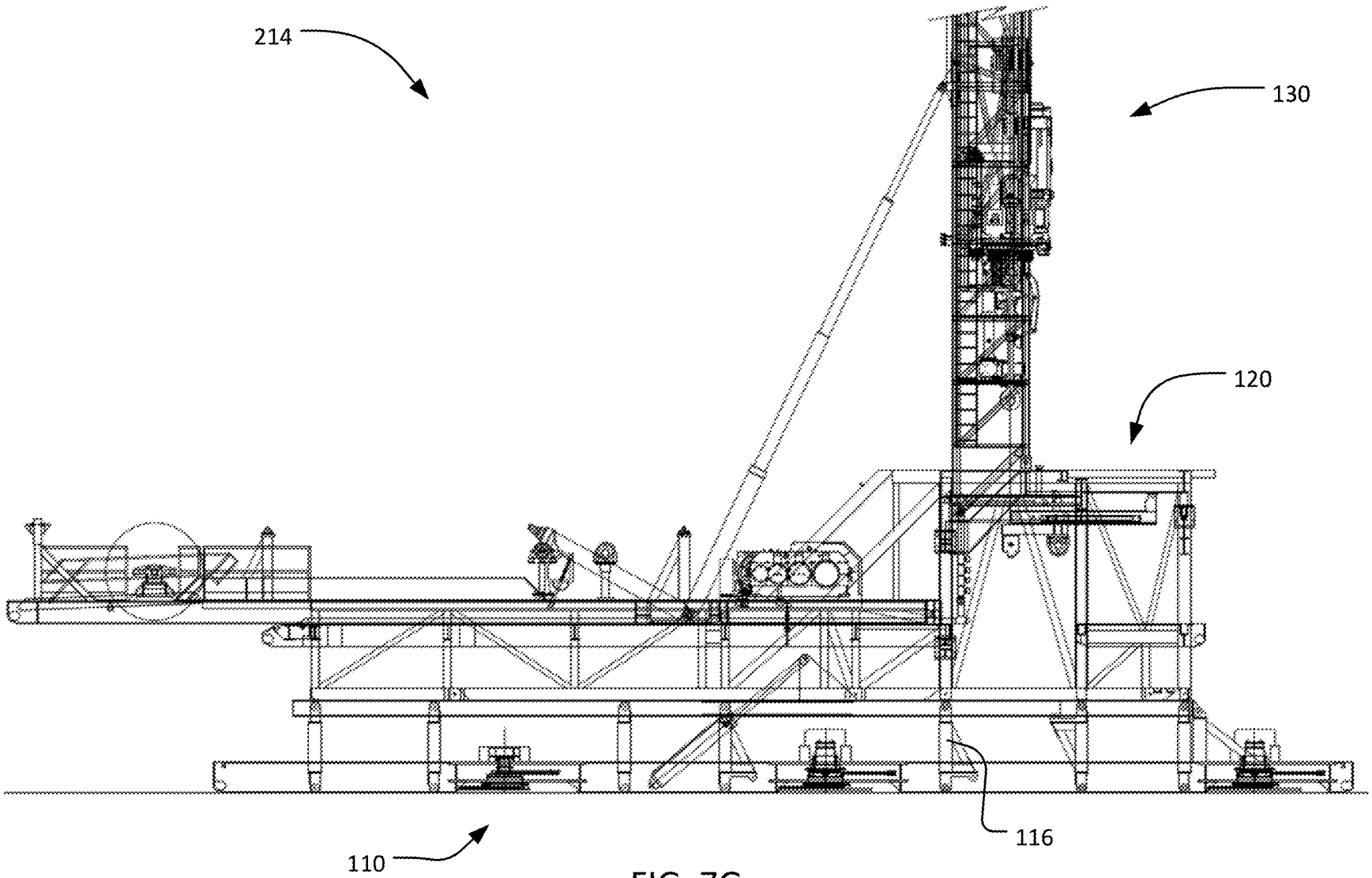

The tower 132 of the mast 130 may be selectively changeable between a collapsed state (FIG. 7E) and a raised or uncollapsed state (FIGS. 1 and 7F). The tower 132 may transition between the collapsed and raised states via the piston arm 136. When in the raised state, the mast pin retaining structure 135 may be selectively secured (e.g., via pins 138, which may be substantially similar to the pins 118 and pins 128) to other modular rig 100 components, such as corresponding pin retaining structure 125 of the platform 120. In this way, the derrick 132 may be attached to the rest of the modular rig system 100. In some embodiments, the derrick 132 may be configured to move into a slanted state, where the tower 132 is angled away from a vertical axis (i.e., the tower 132 may not be perpendicular to the ground). A slanted tower 132 may facilitate horizontal movement of a drill used with the modular rig system 100.

As those skilled in the art know, towers of conventional rig systems have significant mass and are difficult to manipulate into position. These conventional towers thus require heavy machinery (e.g., one or more cranes) to be able to align with the conventional rig platforms for securement thereto. Conversely, installation of the mast 130 may preferably forego the use of additional heavy machinery such as cranes and may instead use one or more alignment actuators 139 (FIG. 5A) to bring the mast 130 and the platform 120 into alignment together.

The alignment actuators 139 may include one or more keys that may join with a corresponding portion of the tower 132 to ensure that the mast pin retaining structure 135 properly aligns with the pin retaining structure 125. In some embodiments, the alignment actuators 139 may adjust (e.g., hydraulically) the tower 132 to align the retaining structures 125 and 135. For example, the alignment actuators 139 may apply force to the tower 132 to move the tower 132 in a vertical direction. Vertically moving the tower 132 may lift, tilt, and/or angle the tower 132 such that the pin retaining structures 125 and 135 are aligned. Once the alignment actuators 139 have moved the mast pin retaining structure 135 into the proper location, rig operators may then place the pins 138 therein to removably secure the tower 132 to the platform 120. As such, the mast 130 may be assembled with the platform 120 without the use of a crane. The alignment actuators 139 may be manually controlled (e.g., via a button press) and/or automatically controlled (e.g., by the computing system 140), and may be controlled independently or in synchronization. The embodiment 100 includes a pair of proximal alignment actuators 139 and a pair of distal alignment actuators 139, with the proximal alignment actuators 139 being between the distal alignment actuators 139 and where the tower 132 attaches to the platform 120. This may be particularly useful in aligning the retaining structures 125 and 135.

The piston arm 136 extends between the mast platform 134 and the derrick 132, and it may be desirable for the piston arm 136 to be hydraulically actuated or otherwise capable of moving a heavy load. The piston arm 136 may be instructed (e.g., via a computing system 140, a button push, etc.) to transition between an unextended/unrotated state (corresponding to the tower 132 at the collapsed state) and an extended/rotated state (corresponding to the tower 132 at the uncollapsed state).

Figure 8:
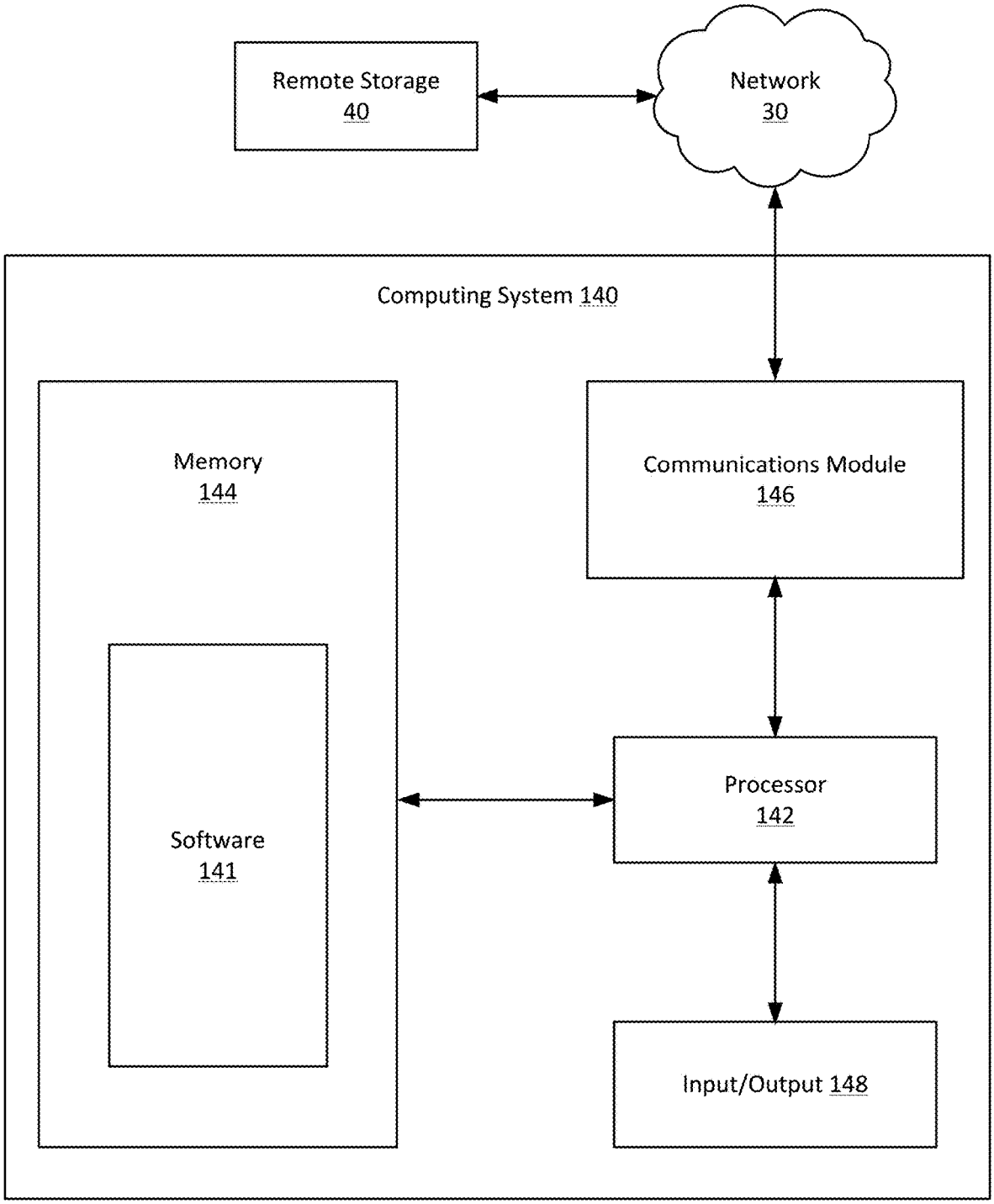
FIG. 8 is a block diagram depicting a computing system of the modular rig system of FIG. 1.

Attention is now drawn to FIG. 8, which is a functional block diagram of the computing system 140 which may be used to implement the various modular rig system and method embodiments according to different aspects of the disclosure. The computing system 140 may be incorporated with the modular rig 100, and/or the computing system 140 may be located within an external computing device (e.g., a controller, a phone, a desktop computer, a laptop computer, et cetera). The computing system 140 may be, for example, a smartphone, a laptop computer, a desktop computer, a flexible circuit board, or other computing device whether now known or subsequently developed. The computing unit 140 comprises a processor 142, a memory 144, a communication module 146, and an Input/Output 148. The processor 142 may include any processor used in computing devices, including a digital or analog processor (e.g., a Nano carbon-based processor). In certain embodiments, the processor 142 may include one or more other processors, such as one or more microprocessors, and/or one or more supplementary co-processors, such as math co-processors. While this document shall often refer to elements in the singular, those skilled in the art will appreciate that multiple such elements may often be employed and that the use of multiple such elements which collectively perform as expressly or inherently disclosed is fully contemplated herein.

The memory 144 may include both operating memory, such as random access memory (RAM), as well as data storage, such as read-only memory (ROM), hard drives, optical, flash memory, or any other suitable memory/storage element. The memory 144 may be a distributed memory 144 such that one portion of the memory 144 is physically separate from another portion of the memory 144, and the memory 144 may include removable memory elements such as a CompactFlash card, a MultiMediaCard (MMC), and/or a Secure Digital (SD) card. In certain embodiments, the memory 144 includes a combination of magnetic, optical, and/or semiconductor memory, and may include, for example, RAM, ROM, flash drive, and/or a hard disk or drive. The processor 142 and the memory 144 each may be located entirely within a single device, or may be connected to each other by a communication medium, such as a USB port, a serial port cable, a coaxial cable, an Ethernet-type cable, a telephone line, a radio frequency transceiver, or other similar wireless or wired medium or combination of the foregoing. For example, the processor 142 may be connected to the memory 144 via the Input/Output 148.

The communication module 146 may be configured to handle communication links (e.g., wired and/or wirelessly) between the computing system 140 and other external devices or receivers and to route incoming/outgoing data appropriately. For example, inbound data from the Input/Output 148 may be routed through the communication module 146 before being directed to the processor 142, and outbound data from the processor 142 may be routed through the communication module 146 before being directed to the Input/Output 148. The communication module 146 may include one or more transceiver modules configured for transmitting and receiving data (e.g., user commands), and using, for example, one or more protocols and/or technologies, such as wires, Bluetooth, GSM, UMTS (3GSM), IS-95 (CDMA one), IS-2000 (CDMA 2000), LTE, FDMA, TDMA, W-CDMA, CDMA, OFDMA, Wi-Fi, WiMAX, or any other protocol and/or technology for communicating with other components, such as through a network 30.

The Input/Output 148 may be any type of connector used for physically interfacing with a smartphone, computer, keyboard, mouse, and/or other devices, such as a USB or mini-USB port. In some embodiments, the Input/Output 148 may include multiple communication channels for simultaneous communication with, for example, other processors, servers, and/or client terminals. In other embodiments, the Input/Output 148 is a power switch for controlling the flow of electricity to other components of the computing system 140.

The memory 144 may store instructions for communicating with other systems, such as a computer. The memory 144 may store, for example, a program (e.g., computer program code) adapted to direct the processor 142 in accordance with the present embodiments. The instructions also may include program elements, such as an operating system. While execution of sequences of instructions in the program causes the processor 142 to perform the process steps described herein, hard-wired circuitry may be used in place of, or in combination with, software/firmware instructions for implementation of the processes of the present embodiments. Thus, unless expressly noted, the present embodiments are not limited to any specific combination of hardware and software.

The memory 144 may include software 141, and the software 141 may contain machine readable instructions configured to be executed by the processor 142. The software 141 may, for example, execute a program to automatically control the modular rig 100 assembly, automatically detect and adjust assembly conditions (e.g., position of legs 116 and/or piston arm 136) of the modular rig 100, communicate to a user the assembly conditions, automatically direct the modular rig 100 in response to a user command, automatically control the alignment actuators 139 to align the pin retaining structures 125 and 135 (e.g., via a sensor detection), et cetera.

The computing system 140 may be in data communication with the network 30. The network 30 may be a wired network, a wireless network (e.g., Bluetooth, GSM, UMTS (3GSM), IS-95 (CDMA one), IS-2000 (CDMA 2000), LTE, FDMA, TDMA, W-CDMA, CDMA, OFDMA, Wi-Fi, WiMAX, etc.), or comprise elements of both. The computing system 140 may be in data communication with a remote storage 40 (e.g., a remote data storage) through the network 30.

Figure 6:
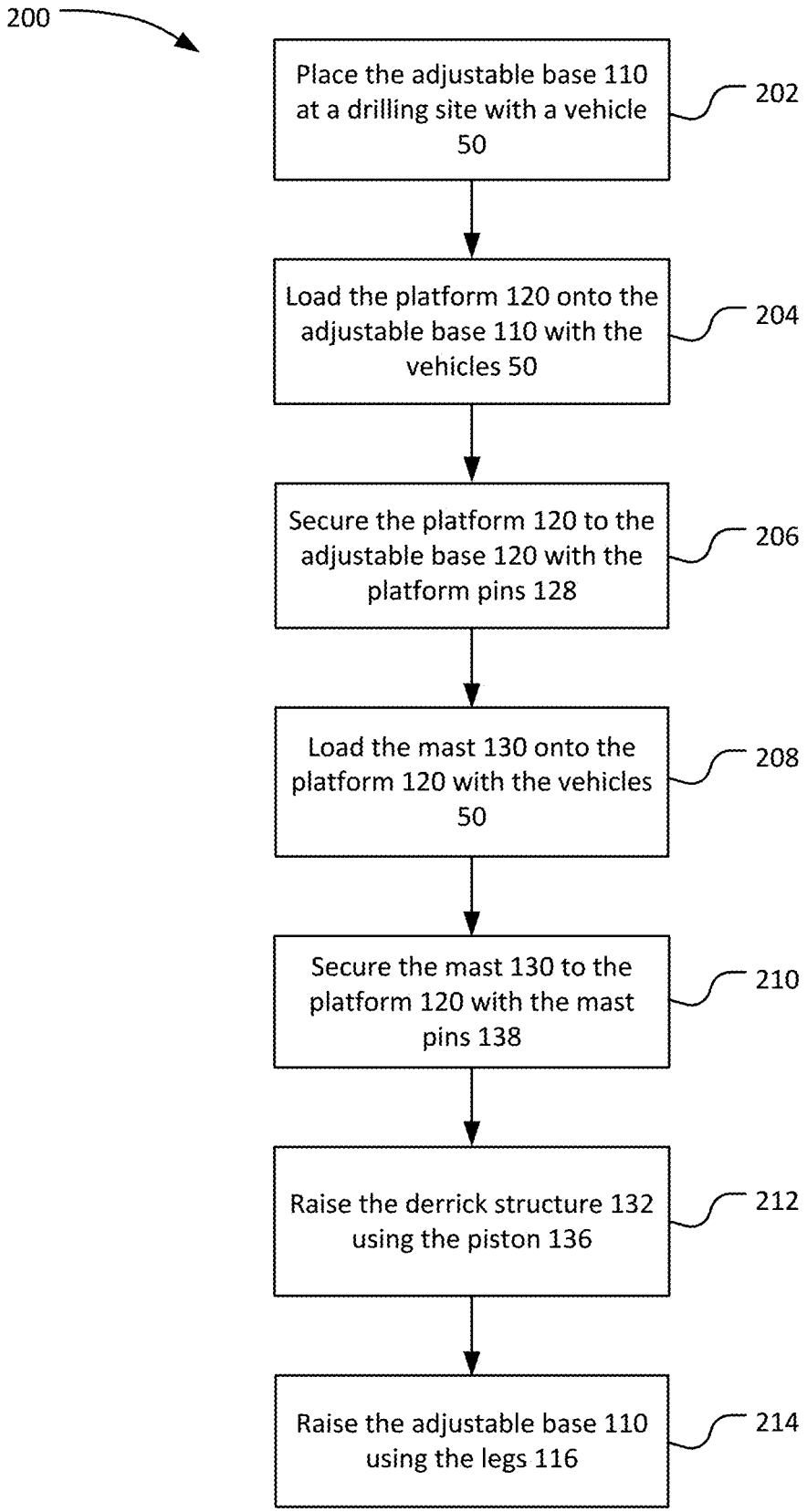
FIG. 6 is a flowchart depicting a method of operating the modular rig system of FIG. 1., according to an embodiment.

FIG. 6 is a flowchart that illustrates the method 200 for operating various embodiments of the modular rig systems disclosed herein. Pictorial examples of the various method 200 steps are shown in FIGS. 7A through 7G, which are meant to be illustrative and are not intended to be limiting. First, at step 202 (FIG. 7A), one or more vehicles 50 (e.g., a rig transport vehicle, a truck, etc.) may place the adjustable base 110 at a drill site. The adjustable base 110 may then be assembled at the location, such as by securing the spreader supports 117 and the braces 119 to the adjustable base 110 with the pins 118. Then, at step at 204 (FIG. 7B), the platform 120 is loaded onto the adjustable base 110 (e.g., onto the base platform 114) by the vehicles 50 (e.g., via towing), where, at step 206 (FIG. 7C), the platform 120 is secured to the adjustable platform 110. The platform 120 may be secured by aligning each of the corresponding pin retaining structures 115 and 125 and inserting a respective pin 128 therein.

Next, at step 208 (FIG. 7D), the mast 130 is loaded onto the platform 120 (e.g., onto the staging area 122) by the vehicles 50, where, at step 210 (FIG. 7E), the mast 130 is secured to the platform 120. The mast 130 may be secured by aligning each of the pin retaining structures 125 and 135 and inserting a respective pin 128 or pin 138 therein. Aligning the pin retaining structures 125 and 135 may involve using the alignment actuators 139 to move (e.g., up, down, tilt) the tower 132 relative to the platform 120. As such, the tower 132 may be removably secured to the platform 120 and made ready for raising without the use of additional heavy machinery such as a crane.

Then, at step 212 (FIG. 7F), the tower 132 may be raised from its collapsed position and seated within the tower receiving portion 124, where the tower 132 is secured in the raised position. The tower 132 may be raised by actuating the piston arm 136 to pivot the tower 132 into place. Once in place, respective pins 138 may be inserted into aligned pin retaining structures 125 and 135 to secure the tower 132 in place. At step 214 (FIG. 7G), the legs 116 are moved into their extended position, thereby moving the entire adjustable base 110 into its extended position. As a result, the entire modular rig system 100 may be raised (i.e., the vertical height of the modular rig system 100 may increase).

The modular rig method 200 described above may have steps omitted, modified, or added to, in various embodiments. For example, the step of selecting a particular tower 132 to assemble with the modular rig 100 based on one or more drill site characteristics may be added. As another example, the step of adjusting a height of the feet 111 and/or the legs 116 may be added. As yet another example, the step of tilting the tower 132 at an angle to provide for slanted drilling may be added. And as still yet another example, the mast platform 134 may include removable decking **134*a* (FIG. 5B) that is in place when the piston arm 136 is at the retracted configuration and the extended configuration, but which must be removed to allow the piston arm 136 to move between the retracted and extended configurations. When the piston arm 136 is at the retracted configuration, the decking 134*a* may at least partially cover the piston arm 136. Further, the artisan would understand that the steps of the method 200 may be reversed and performed in a backwards order to dismantle the modular rig system 100 and prepare the system 100** for transport (e.g., to another dig site).

As described, the modular rig system 100 may be efficiently transported to a drill site, where it may be assembled quickly relative to conventional drilling rigs. Because the modular rig system 100 does not require certain heavy machinery (e.g., a crane) for assembly/disassembly, time and expense may be saved by not having to transport and operate such heavy machinery. Furthermore, the versatility of the modular rig system 100 may make the system 100 more useful than conventional drilling platforms. For example, if a drilling task requires a larger derrick than a conventional system has, another conventional system must be acquired to accomplish the task. The modular rig system 100, however, may merely exchange its current derrick 132 with a different sized derrick 132 to be able to complete the drilling task. By only having to exchange the derrick of the system 100 (as opposed to the entire drilling rig setup), the system 100 may provide for a cheaper and easier solution to such a problem.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations and are contemplated within the scope of the present disclosure. Not all steps listed in the various figures need be carried out in the specific order described.

The invention claimed is:

1. A modular rig system, comprising:

a platform having an attachment point; and a mast separable from the platform, the mast having:

a transport foundation positioned atop a portion of the platform;

a tower movable relative to the transport foundation between transport and use configurations, the tower having an attachment point;

an alignment actuator operably coupled to the transport foundation to adjust positioning of the tower while the tower is at the transport configuration such that the platform attachment point and the tower attachment point are aligned; and a piston arm pivotably coupled to the transport foundation and the tower for moving the tower between the transport and use configurations, the piston arm being separate from the alignment actuator.

2. The modular rig system of claim 1, further comprising a base, the platform and the mast being positioned atop and operably locked to the base.

3. The modular rig system of claim 1, wherein the tower at the use configuration is generally perpendicular to the tower at the transport configuration.

4. A modular rig system, comprising:

a platform having an attachment point and a mast separable from the platform, the mast having:

a transport foundation;

a tower movable relative to the transport foundation between transport and use configurations, the tower having an attachment point an alignment actuator operably coupled to the transport foundation to adjust positioning of the tower while the tower is at the transport configuration such that the platform attachment point and the tower attachment point are aligned; and a piston arm pivotably coupled to the transport foundation and the tower for moving the tower between the transport and use configurations;

wherein the alignment actuator is affixed to the transport foundation and movable along a single axis.

5. The modular rig system of claim 4, wherein the alignment actuator is hydraulically actuated.

6. The modular rig system of claim 4, wherein the alignment actuator is a proximal alignment actuator, and further comprising a distal alignment actuator, the proximal alignment actuator being between the distal alignment actuator and the tower attachment point, the proximal and distal alignment actuators being independently operable to adjust positioning of the tower while the tower is at the transport configuration.

7. The modular rig system of claim 6, wherein the proximal alignment actuator and the distal alignment actuator are hydraulically actuated.

8. The modular rig system of claim 1, further comprising decking, the decking being present when the piston arm is at a retracted configuration and present when the piston arm is at an extended configuration, the decking having to be removed to allow the piston arm to move between the retracted and extended configurations, the decking at least partially covering the piston arm when the piston arm is at the retracted configuration.

9. The modular rig system of claim 1, wherein the alignment actuator is a proximal alignment actuator, and further comprising a distal alignment actuator, the proximal alignment actuator being between the distal alignment actuator and the tower attachment point, the proximal and distal alignment actuators being independently operable to adjust positioning of the tower while the tower is at the transport configuration.

10. A modular rig system assembled without use of a crane, the modular rig system comprising:

a platform having pin retaining structure; and a mast separable from the platform, the mast having:

a transport foundation;

a tower movable relative to the transport foundation between transport and use configurations, the tower having pin retaining structure;

an alignment actuator operably coupled to the transport foundation to adjust positioning of the tower while the tower is at the transport configuration such that the pin retaining structure of the platform and the pin retaining structure of the tower are aligned;

a pin selectively passing through the pin retaining structure of the platform and the pin retaining structure of the tower to couple the platform to the tower; and a piston arm pivotably coupled to the transport foundation and the tower for moving the tower between the transport and use configurations;

wherein the tower is supported generally horizontally atop the transport foundation for transport with the transport foundation while the tower is at the transport configuration.

11. The modular rig system of claim 10, wherein the tower at the use configuration is generally perpendicular to the tower at the transport configuration.

12. The modular rig system of claim 10, wherein the alignment actuator is a proximal alignment actuator, and further comprising a distal alignment actuator, the proximal alignment actuator being between the distal alignment actuator and the pin retaining structure of the tower, the proximal and distal alignment actuators being independently operable to adjust positioning of the tower while the tower is at the transport configuration.

13. The modular rig system of claim 12, wherein:

the proximal alignment actuator is a pair of proximal alignment actuators; and the distal alignment actuator is a pair of distal alignment actuators.

14. The modular rig system of claim 13, further comprising a computer system automatically controlling the alignment actuators.

15. The modular rig system of claim 13, further comprising at least one input for manually controlling the alignment actuators.

16. The modular rig system of claim 10, wherein the mast does not have an anchor point for attachment to a crane.

17. A method of assembling a rig system without a crane, comprising the steps:

affixing a platform atop a base;

transporting a mast having a tower atop a transport foundation, the mast further comprising a piston arm, the piston arm being rotatably coupled to the mast and to the transport foundation;

pulling the transport foundation over a portion of the platform and affixing the transport foundation of the mast atop the portion of the platform;

adjusting a position of the tower using a linear alignment actuator such that an attachment point of the tower is aligned with an attachment point of the platform;

pinning the attachment point of the tower to the attachment point of the platform; and raising the tower using the piston arm.

18. The method of claim 17, wherein the step of transporting includes transporting the tower atop the transport foundation by truck.

19. The method of claim 17, wherein the step of adjusting a position of the tower using a linear alignment actuator includes manually controlling the linear alignment actuator.

20. The modular rig system of claim 10, wherein the piston arm is separate from the alignment actuator.

* * * * *